United States Patent [19]

Bearint et al.

[11] Patent Number: 4,752,189

[45] Date of Patent: Jun. 21, 1988

[54] VALVE ARRANGEMENT FOR A VARIABLE DISPLACEMENT COMPRESSOR

[75] Inventors: David E. Bearint, Decatur, Ill.; John S. Lee, Walkersville, Md.

[73] Assignee: Diesel Kiki Co., Ltd., Tokyo, Japan

[21] Appl. No.: 939,650

[22] Filed: Dec. 9, 1986

[51] Int. Cl.[4] ..... F04B 1/06; F04B 1/08

[52] U.S. Cl. ..... 417/222; 417/270

[58] Field of Search ..... 137/498, 504; 417/222, 417/270, 299, 296; 62/228.3, 209

[56] References Cited

U.S. PATENT DOCUMENTS

| | | | |
|---|---|---|---|
| 2,307,949 | 1/1943 | Phillips | 137/498 |
| 3,122,162 | 2/1964 | Sands | 137/498 |
| 3,496,962 | 2/1970 | Tuzson | 137/504 |
| 3,784,327 | 1/1974 | Lonnemo | 417/222 |
| 3,941,150 | 2/1976 | Anderson | 137/504 |
| 4,145,163 | 3/1979 | Fogelberg | 417/222 |
| 4,344,285 | 8/1982 | Ridge | 417/218 |
| 4,519,750 | 5/1985 | Kurahashi | 417/296 |
| 4,533,299 | 8/1985 | Swain | 417/222 |
| 4,543,043 | 9/1985 | Roberts | 417/222 |

*Primary Examiner*—William L. Freeh

*Attorney, Agent, or Firm*—Frishauf, Holtz, Goodman & Woodward

[57] ABSTRACT

A valve arrangement for a variable displacement refrigerant compressor comprising one or more valve assemblies adapted to regulate fluid communication between the compressor's discharge cavity and the interior of the crankcase as a function of a predetermined fluid pressure differential. The valve assemblies operate to modulate, as a function of the ambient temperature, the set point of the compressor thereby avoiding evaporator freeze up.

14 Claims, 2 Drawing Sheets

VALVE ARRANGEMENT FOR A VARIABLE DISPLACEMENT COMPRESSOR

FIELD OF THE INVENTION

This invention generally relates to variable displacement refrigerant compressors and, more particularly, to a valve arrangement which regulates the refrigerant gas pressure behind the pistons to vary the compressor's displacement.

BACKGROUND OF THE INVENTION

In variable displacement refrigerant compressors, displacement or capacity control is provided by controlling the refrigerant gas pressure differential between the backside of the pistons or crankcase and compressor suction. A suction pressure biased control valve is most commonly used to control this pressure differential. In such control valves, the suction pressure operates on a diaphragm or evacuated bellows so that when suction pressure increases (usually associated with higher ambient temperatures and/or lower rotating speeds) it causes the control valve to effect decreased crankcase-suction pressure differential by allowing the crankcase to bleed gas to suction. As is understood by those in the art, the gas bleeding to suction has the effect of increasing the wobble plate angle and, thus, compressor displacement. Eventually, maximum compressor displacement is obtained when there is effected zero crankcase—suction pressure differential. On the other hand, when the air conditioning capacity demand is lowered (usually associated with lower ambient temperatures) so is the suction pressure. The control valve operates under the influence of the lowered suction pressure to close off the crankcase gas bleeding to suction so as to effect an increased crankcase—suction pressure differential. An increase in the crankcase—suction pressure differential has the effect of reducing the wobble plate angle and thereby decreasing compressor displacement.

To be accepted by Industry, a variable displacement automotive-type air conditioning compressor must be capable, during initial pull down, of approaching the same low evaporator pressures and temperatures as those obtainable by fixed displacement compressors. With a variable displacement compressor, a low suction pressure control point may be necessary and feasible during high ambient temperature operation, but it cannot safely be maintained into the lower ambient temperature range. In the high ambient temperature range, the heat load on the evaporator and the mass flow rate through the cooling system are high. A high pressure drop in the suction line is also experienced when the compressor is operated in high ambient temperatures. The high pressure drop in the suction line keeps evaporator pressures and temperatures up and out of the freeze up region. Of course, as ambient temperature decreases, so does the mass flow rate in the cooling system and the pressure drop in the suction line. As evaporator pressure converges on the low suction control point, the probability of evaporator freeze up increases. Accordingly, there is a need for a valve arrangement which controls compressor displacement in a variable displacement compressor so as to maintain a near constant evaporator pressure regardless of ambient temperature.

Various control valves for regulating the flow of fluid from the crankcase to suction in a wobble plate compressor are taught in the art. Dual acting valves responsive to the suction discharge pressure differential are also known in the art.

U.S. Pat. No. 3,959,983 discloses communication between crankcase and suction cavities to provide wobble plate control. In the U.S. Pat. No. 3,959,983 a pump operates to the relief limit of a valve and pumps oil to a chamber with a stroke control piston assembly. A zero—stroke valve is actuated by oil pressure and controls the gas flow from the crankcase to a control valve in response to oil pressure. The control valve is responsive to the pressure sensed in the suction line by a diaphragm pressure disposed to move a valve element. Fluid at discharge pressure blows by and is communicated past the pistons to the crankcase from the discharge cavity.

U.S. Pat. No. 4,037,993 teaches the communication of discharge gas pressure through a centered passageway to move a piston against a biased spring. A control valve assembly controls the flow of discharge or suction gas pressure to the center passageway in response to crankcase pressure. The control valve assembly includes a bellows valve which further provides communication between the suction cavity and the crankcase cavity.

U.S. Pat. No. 4,073,603 illustrates a control valve assembly utilizing a solenoid operator and a Sylphon bellows. This control valve regulates fluid pressure between the crankcase and the suction port.

U.S. Pat. No. 4,145,163 discloses a control valve for a swash plate compressor, which swash plate translates on a drive shaft. A bellows operated slide valve communicates fluid at discharge pressure to the crankcase in response to changes in the fluid suction pressure.

U.S. Pat. No. 4,428,718 teaches a control valve for a variable capacity wobble plate compressor. The valve arrangement in this patent includes a three chamber arrangement. The fluid discharge and fluid suction pressures are biased against the crankcase pressure in an intermediate chamber, as well as each other, to provide a control means for the wobble plate. This device utilizes a bellows valve in the suction pressure chamber and a spring-loaded ball valve in the discharge pressure chamber with a mechanical connection therebetween to bias each other.

SUMMARY OF THE INVENTION

The present invention provides a simple and economical valve arrangement which permits communication between the compressor's discharge plenum and the crankcase. The valve arrangement of the present invention includes one or more pressure actuated valve assemblies which open at lower discharge pressures for the purpose of increasing the suction pressure maintained by the compressor. The increased suction pressure insures that evaporator pressures and temperatures are maintained above the level where condensate could freeze on the heat exchanger surfaces of the evaporator.

Specifically, the valve arrangement of the present invention includes one or more spring biased valves which are responsive to discharge pressure for controlling gas or fluid flow from discharge pressure conditions to the interior of the crankcase and thereby controlling compressor displacement. When a variable displacement refrigerant compressor is running steady state and modulating capacity at partial stroke, the compressor's suction pressure setpoint can be altered by changing the mass flow rate of gas to the crankcase. A decrease in control gas mass flow rate will reduce the compressor setpoint. Additional mass flow rate will increase the compressor setpoint. The valve arrangement of the present invention allows increased control mass flow rate to the crankcase. As discharge pressure decreases with lowering ambient conditions, a level is reached where the spring force of the resilient spring associated with one of said valve assemblies overcomes the pressure forces acting to keep the valve closed. When the discharge pressure drops below a given level, the valve opens allowing additional mass flow into the crankcase. As a result of the additional mass flow into the crankcase, suction pressure increases. If two such valve assemblies are used, one valve assembly may have a different spring force from that of the other valve assembly. Accordingly, one valve may open at a first predetermined discharge pressure, whereby allowing safe operation of the evaporator to a predetermined ambient temperature level, while the second valve opens at a second predetermined discharge pressure which allows safe operation of the evaporator to a still lower ambient temperature level.

In view of the above, a primary object of this invention is the provision of a compressor discharge compensation apparatus which permits an increase in suction pressure to insure that evaporator pressures and temperatures are maintained above the level where condensate could freeze on the heat exchange surfaces of the evaporator at low ambient temperatures.

BRIEF DESCRIPTION OF THE DRAWINGS

Having in mind the above object and other attendant advantages that would be evident from an understanding of this disclosure, the invention comprises the devices, combination and arrangement of parts as illustrated in the presently preferred form of the invention which is hereinafter setforth in detail to enable those skilled in the art to readily understand the function, operation, construction and advantages of same when read in conjunction with the accompanying drawings in which.

DETAILED DESCRIPTION OF THE PRESENT INVENTION

Figures 1, 5, 6:
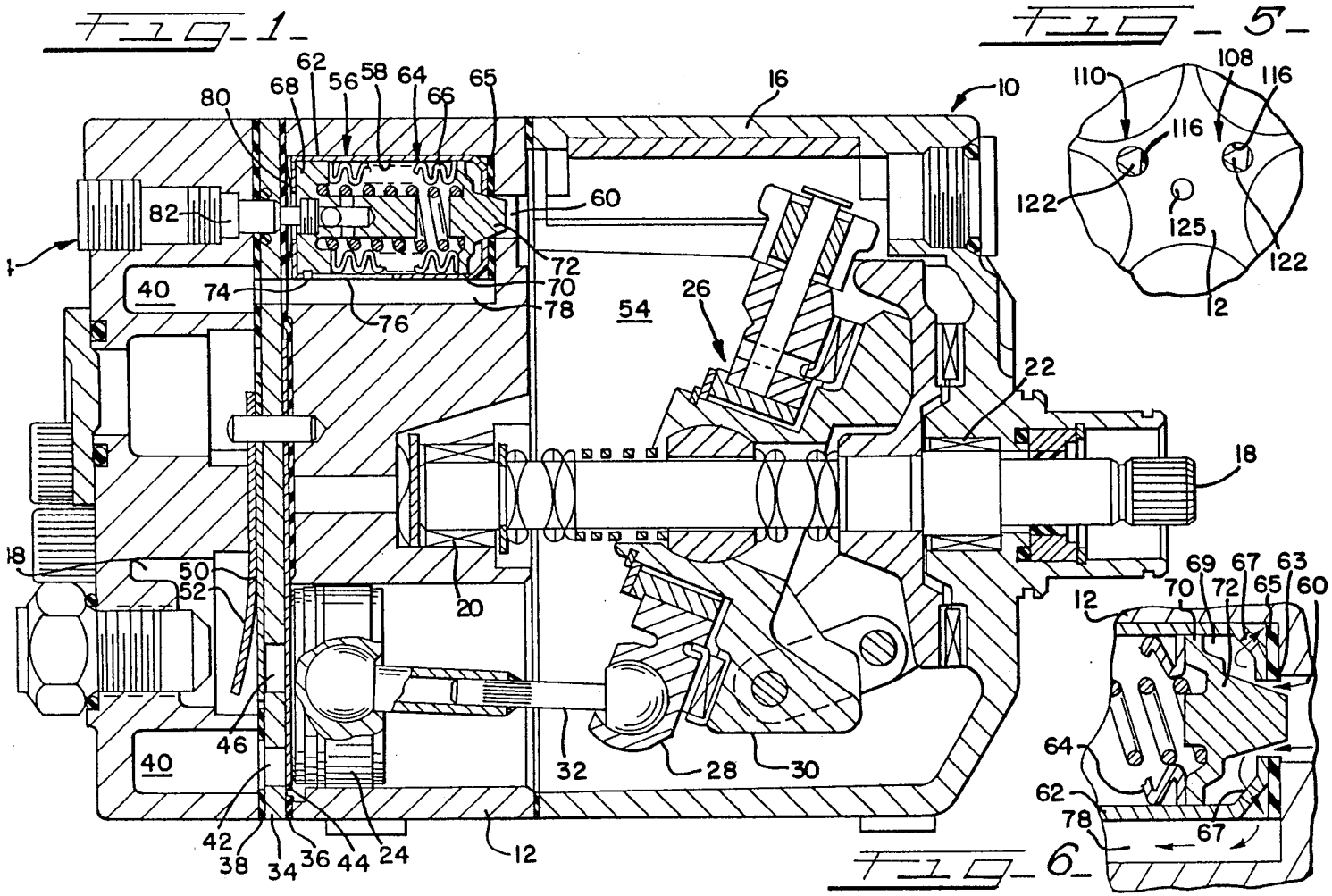
FIG. 1 is a cross sectional view of a controlled displacement refrigerant compressor of the variable angle wobble plate type in which the present invention is embodied.
FIG. 5 is a partial end view of the anti-freeze valve assemblies illustrated in FIGS. 3 and 4.
FIG. 6 is an enlarged partial sectional view of the control valve assembly of the present invention.

Referring now to the drawings, wherein like reference numerals indicate like parts throughout the several views, in FIG. 1 there is shown a controlled or variable displacement refrigerant compressor 10 of the variable angle wobble plate type. The compressor 10 comprises part of an air-conditioning system having the normal condenser, orifice tube, evaporator, and accumulator arranged in that order between the compressor's discharge and suction sides. The compressor 10 includes a cylinder block 12 having a head assembly 14 and a crankcase 16 sealingly clamped to opposite sides thereof. A drive shaft 18 is centrally supported in the compressor. Suitable bearings 20 and 22 and ancillary devices are provided in the cylinder block 12 and crankcase 16, respectively, to support the shaft for rotation. The drive shaft extends through the crankcase and is adapted to be drivingly connected to an engine or power source (not shown).

In the preferred embodiment, the cylinder block 12 has five pistons 24 extending therethrough (only one being shown). The five pistons are angularly spaced equally about and radially spaced equally from the longitudinal axis of drive shaft 18. Each of the pistons are operably connected to a conventional drive assembly 26. Suffice it to say, the drive assembly 26 includes a nonrotating wobble plate 28 received about the drive shaft 18, a drive plate 30 operably associated with the drive shaft 18, and connecting or piston rods 32. The piston rods separately connect the backside of each piston to the wobble plate 28. As readily understood by those skilled in the art, the angle of the wobble plate may be varied with respect to the axis of the drive shaft between a maximum angle position which is full stroke and a zero angle position to infinitely vary the stroke of the pistons and, thus, the displacement or capacity of the compressor between these extremes.

The working ends of the cylinders or pistons 24 are covered by a valve plate 34. Gaskets 36 and 38 are located on opposite sides of said valve plate 34 and are clamped to the cylinder block 12 between the latter and the head assembly 14. The head assembly 14 is provided with a suction cavity or plenum 40 which is connected through an external port (not shown) to receive gaseous refrigerant from the accumulator of the cooling system downstream of the evaporator. The suction cavity 40 is open to an intake port 42 provided in the valve plate 34 at the working end of each cylinder where refrigerant is admitted to the respective pistons on their suction stroke, each through a suction reed 44. Then, on the compression stroke, a discharge port 46, open to the working end of each piston, allows compressed refrigerant to be discharged into a discharge cavity or plenum 48 provided in the head assembly 14 through a discharge reed 50. The extent of discharge reed opening is limited by a rigid stop 52 clamped to the valve plate 34. From the discharge cavity of the compressor the compressed gaseous refrigerant is delivered to the condenser of the cooling system from whence the liquified refrigerant is delivered through the orifice tube to the evaporator and accumulator to complete the refrigerant circuit.

As will be understood by those skilled in the art, and given the above described compressor arrangement, the angle of the wobble plate 28 and thus compressor displacement is primarily controlled by controlling the pressure in the sealed interior 54 of the crankcase 16 behind the pistons 24 relative to the suction pressure. That is, the angle of the wobble plate is primarily determined by a force balance on the pistons. A slight elevation of the crankcase—suction pressure differential above a compressor setpoint creates a net force on the pistons that results in a reduction of the wobble plate angle and, therefore, a reduction in compressor compacity.

It has been the practice, heretofore, to employ a control valve assembly to control the crankcase—suction pressure differential. Such a control valve usually includes a bellows or diaphragm member which is biased by compressor suction pressure. When the air-conditioning capacity demand is high and the resulting suction pressure rises above the compressor's suction pressure set point, the control valve assembly opens to maintain a low flow resistance from crankcase to suction such that there is a very low crankcase—suction pressure differential. As a result, the wobble plate will then angle to its full stroke position establishing maximum compressor displacement. On the other hand, when the air conditioning capacity demand is lowered and the suction pressure decreases or falls toward the control or compressor suction pressure setpoint, the control valve, with just suction pressure bias, then operates to restrict the crankcase connection with suction and allows pressure in the crankcase to increase as a result of control gas flow into the interior 54 of the crankcase. This has the effect of increasing the crankcase—suction pressure differential which, on slight elevation, creates a destroking force on the pistons resulting in a reduction of the wobble plate angle and therefore reduces the compressor displacement.

In the illustrated embodiment, an adjustable control valve assembly 56, which is responsive to suction pressure, is arranged in an aperture 58 provided in the cylinder block 12. The aperture is closed at its outer end by the valve plate 34. The inner end of the aperture opens to the interior 54 of the crankcase through a passageway 60. A cup shaped bellows cover 62 having an aperture 63 (FIG. 6) provided at its inner end is accommodated in the aperture 58. An evacuated, resilient bellows assembly 64, which expands and contracts in response to suction pressure changes, is concentrically located and slidably entrapped for linear displacement between the ends of the bellows cover 62. The bellows assembly includes a corregated thin wall metal casing 66 one end of which is sealingly closed by a valve seat 68. The other end of the bellows 66 is sealingly closed by an end member 70 having a truncated conicle projection 72 which extends through aperture 63 in cover 62 and extends partially into the passageway 60. As will be understood, the disposition of the projection 72 relative to the aperture 63 in bellows cover 62 operates to control crankcase bleed to suction. A radially extending pin 74 provided on the valve seat 68 and extending through a slot 76 in the bellows cover 62 prevents the valve seat 68 from turning while allowing linear displacement of the bellows assembly. An operator controlled adjusting screw 82 is operably associated with the valve seat 68 to provide adjustment of the suction pressure set point. A suitably apertured gasket 65 through which pintle 72 extends may be arranged between the inner end of the bellows cover 62 and cylinder block 12. When arranged in the position illustrated in FIG. 1, the control valve assembly 56 closes the interior 54 of the crankcase from communicating with a conduit 78 leading to the suction cavity 40. A resilient member 80 in the form of a curved spring washer is disposed between the outer end of cover 62 and the valve plate 34. The captured spring provides a closing force which urges the inner end of cover 62 against the gasket 65 to seal around the passageway 60.

As may be best illustrated in FIG. 6, the bellows cover 62 may be provided with a series of apertures 67 which permit communication between the interior 69 of the bellows cover 62 and passageway 78. When the pintle or projection 72 is laterally or axially displaced away from the aperture 63, gas is permitted to flow from the interior 54 (FIG. 1) of the crankcase, through passageway 60, and into the bellows cover interior 69 between end member 70 and the inner end of cover 62 from whence it flows through apertures 67 and, ultimately, to the suction plenum 40 (FIG. 1). Although the pintle 62 is permitted axial movement away from passageway 60, the captured spring 80 maintains the cover 62 pressed against the gasket 65 to prevent gas from escaping between passageway 60 and cover 62.

Figure 2:
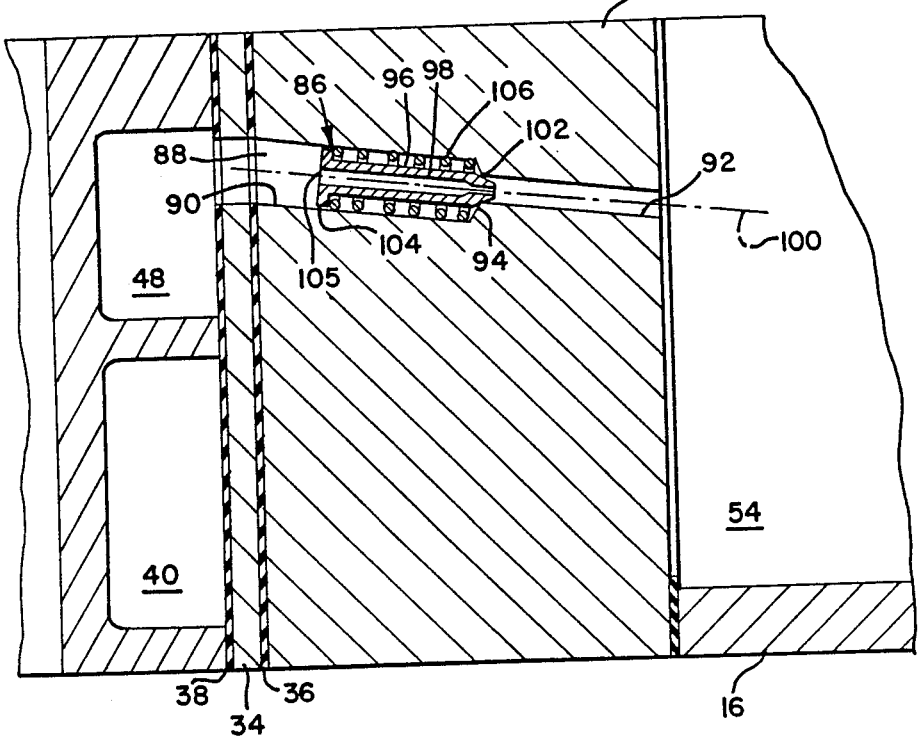
FIG. 2 is a cross sectional view of a anti-freeze valve assembly arranged in a cylinder block of the refrigerant compressor illustrated in FIG. 1.

According to the present invention there is provided an anti-freeze valve arrangement which regulates the refrigerant gas pressure in the crankcase interior to vary the compressor's displacement. The anti-freeze valve arrangement of the present invention may include one or more valve assemblies generally designated in FIG. 2 by reference numeral 86. Each valve assembly is responsive to compressor discharge pressure for controlling compressor displacement or capacity and to provide improved compressor control or function. As shown in FIG. 2, the anti-freeze valve arrangement of the present invention includes a passageway 88 which, in the preferred embodiment, is provided in the cylinder block 12 and passes through the valve plate 34 and associated gaskets 36 and 38. The passageway or setpoint shift valve duct 88 is a stepped throughbore which opens on one side to the discharge plenum 48 and on the other end to the interior 54 of the crankcase. In the presently preferred embodiment, the passageway is formed with two bore portions 90 and 92, with bore portion 92 being smaller in diameter than bore portion 90. A tapered step or shoulder 94 is provided at the juncture of the first and second bore portions and defines a valve face. In the presently preferred embodiment, the valve assembly 86 includes a needle valve 96 comprising a generally cylindrical body 98 having a longitudinal axis 100 and a tapered end portion 102 which is engageable with the valve face. Opposite the tapered end portion 102, the valve body 98 is provided with an enlarged flatted head portion 104. The needle valve 96 may also include a throughbore orifice 105 extending through the body 98 concentric with its longitudinal axis 100 which allows a limited flow of control gas to the interior of the crankcase when the anti-freeze valve assembly is closed and which compliments leakage or gas blow-by past the pistons to attain the desired control or functional aspects of the compressor. A bias spring 106 surrounding the valve body 98 is positioned in passageway 88 between shoulder 94 and head portion 104. The spring 106 resiliently urges the valve body to the left, as seen in FIG. 2, against the pressure in the discharge chamber 48 and toward a normally "open" position. When the valve 86 is "open" fluid is permitted to flow from discharge pressure conditions to the interior 54 of the crankcase. When the discharge pressure acting on the flatted head portion 104 of the valve is greater than the spring force of the resilient member 106, the valve is urged toward its "closed" position. In its closed position, the tapered end portion 102 engages the valve face 94 provided in the passageway 88 in a manner limiting or restricting fluid flow between the discharge pressure conditions and the interior 54 of the crankcase as described above.

Figure 3:
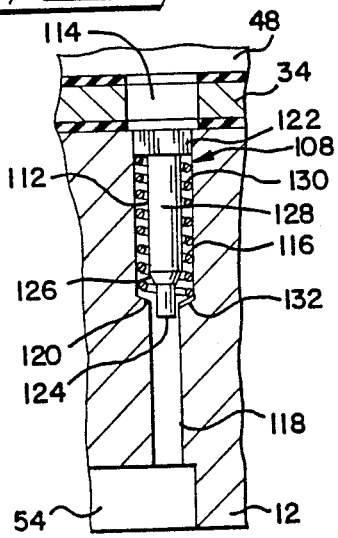
FIGS. 3 and 4 are alternative embodiments of anti-freeze valve assemblies which could be used in combination with the refrigerant compressor illustrated in FIG. 1.
Figure 4:
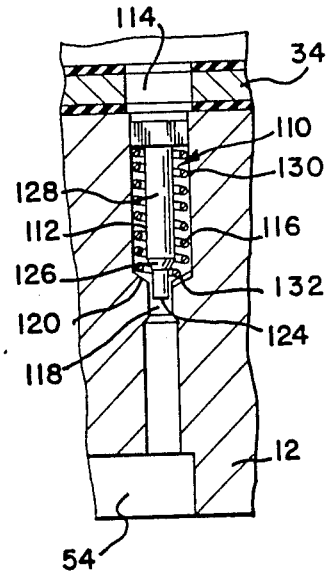

As mentioned above, the valve arrangement of the present invention may include more than one valve assembly for regulating crankcase pressure. FIGS. 3 and 4 illustrate two alternative valve assemblies 108 and 110 which may be used in combination for controlling the pressure in the interior 54 of the crankcase. Because the valve assemblies 108 and 110 are substantially similar to each other, only valve assembly 108 will be discussed in detail. It should be appreciated, however, that like reference numerals indicate like parts for valve assembly 110. Like the valve assembly 86, the valve assembly 108 illustrated in FIG. 3 includes an actuating valve member 112 which is slidably arranged within a stepped throughbore 114 which opens at one end to the discharge chamber 48 and at its other end to the interior 54 of the crankcase. The stepped passageway 114 is formed with two bore portions 116 and 118 with bore portion 118 being smaller in diameter than bore portion 116. A tapered step or shoulder 120 is provided at the juncture of the first and second portion 116 and 118. As may be best illustrated in FIG. 5, the end of the actuating pin 112 which is exposed to discharge pressure may have a flatted head portion 122 which is slidably received in bore portion 116 to permit control gas to flow from discharge pressure conditions to the interior 54 of the crankcase. Returning to FIG. 3, the actuating pin member 112 at its opposite end is formed with a reduced valve needle or stem portion 124 which is adapted to fit into the second bore portion 118. A tapered portion 126 joins the stem portion 124 to a body portion 128 of the valve member 112. The actuating pin member of the valve assembly is biased toward an open position under the influence of a resilient member 130 in the form of the compression spring having a predetermined spring rate. One end of spring 130 is seated on the shoulder or step 120 of the passageway 114 while the other end acts against head portion 122 of the valve. The tapered portion 126 on the valve member 112 provides a valve face which is engageable with the tapered step 120 to limit fluid flow through the passageway 114 when the valve assembly is closed. A small amount of control gas at discharge pressure, however, bleeds into the interior 54 of crankcase 16 through a bleed hole or aperture 132 defined in the step or shoulder 120. The valve assèmblies 108 and 110 are adapted to open their respective passageways under varying discharge levels. One manner or means for effecting that end would be to have different distances between the underside of head portion 122 and seat 120 for valves 108 and 110. Moreover, the diameters of the stem portions 124 of each valve assembly may be slightly different. As will be readily understood, such size difference will determine the flow rate through the passageway 114. As with valve assembly 86, either or both valve assemblies 108 and 110 may each be provided with an axial throughbore. Alternatively, however, a passageway 125 (FIG. 5) extending between the discharge plenum and the interior 54 of crankcase may be provided to allow a limited flow of control gas to the interior 54 of the crankcase when either or both anti-freeze valve assemblies 108 and 110 are closed.

Describing now the operation of the compressor, gaseous refrigerant leaving the accummulator in the cooling system at low pressure enters the compressor's suction cavity 40 and is discharged to the compressor discharge cavity 48 and thence to the condenser of the cooling system. At the same time, gaseous refrigerant at suction pressure acts on the control valve arrangement 56. The compressor suction pressure setpoint or control point for the control valve assembly 56 which determines displacement change is selected so that when the air conditioning capacity demand is high, the suction pressure, at the compressor after the pressure drop from the evaporator, will be above the predetermined control point. The control valve assembly 56 is calibrated at assembly so that the then existing suction—crankcase pressure differential acting on the control valve arrangement is sufficiently high to maintain a bleed from crankcase to suction so that a very low crankcase—suction pressure differential is developed. As a result, the wobble plate will remain in its maximum angle position to provide maximum compressor displacement.

As ambient temperature conditions decrease so does the system mass flow rate and the pressure drop in the suction line. As the pressure drop in the suction line decreases and the suction pressure converges on the set point, the pintle or projection 72 of the bellows assembly 64 is urged into a position whereat it begins to restrict the crankcase connection with the suction and thereby increases the crankcase—suction pressure differential. As mentioned, the angle of the wobble plate 28 is primarily controlled by a force balance on the pistons 24 so that only a slight elevation of the crankcase—suction pressure differential is effective to create a net force on the pistons that results in a moment about the wobble plate pivot axis that reduces the wobble plate angle and thereby the compressor displacement. A reduction in compressor displacement translates into a decrease in mass flow rate and a decrease in the pressure drop in the suction line. As such, evaporator pressure converges on the compressor suction pressure setpoint and the probability of evaporator freeze up increases.

It has been found that when a controlled displacement compressor as described above is running steady state and modulating capacity at partial stroke, the compressor's suction pressure setpoint or control point may be altered by changing the mass flow rate of gas to the crankcase. A decrease in control gas mass flow rate will reduce the setpoint while additional mass flow will increase the setpoint. The anti-freeze valve arrangement of the present invention allows an increase in mass flow rate to the interior 54 of the crankcase. That is, below a predetermined pressure differential between the interior 54 of crankcase 16 and the discharge cavity 48, the bias spring associated with the anti-freeze valve assembly moves the needle valve or actuating pin member away from the valve face to open the valve assembly whereby allowing gas to flow from discharge pressure conditions to the interior 54 of the crankcase. As the fluid mass in the interior 54 of the crankcase 16 increases, the control valve increases the compressor's suction pressure set point or control point. Increased fluid flow to the interior 54 of the crankcase moves the wobble plate 28 and pistons 24 to an even lower stroke condition and establishes an increase in suction pressure. Of course, if two valve assemblies having varying opening spring forces are used as shown in FIGS. 3 and 4, one valve assembly may be preset to allow gas flow from discharge pressure conditions to the interior 54 of the crankcase, below a first predetermined discharge—crankcase pressure differential while the other valve assembly may be preset to allow gas flow from discharge to the interior 54 of the crankcase below a second predetermined discharge—crankcase pressure differential. This compressor displacement compensation feature permits an increase in suction pressure which insures that evaporator pressures and temperatures are maintained above the level where condensate could freeze on the heat exchanger surfaces of the evaporator at low ambients.

Thus, there has been provided a VALVE ARRANGEMENT FOR A VARIABLE DISPLACEMENT COMPRESSOR which fully satisfies the objects, aims and advantages set forth above. While the invention has been described in connection with a specific embodiment thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

Thus having adequately described our invention, what we claim is:

1. In a variable displacement compressor having a crankcase wherein pressure is established and controlled, a cylinder block defining compression chambers into which fluid is admitted from a suction cavity and from which fluid is exhausted under pressure into a discharge cavity, pistons received in respective ones of said compression chambers, a drive shaft, a wobble plate arranged in said crankcase and pivotally and slidably fitted on said drive shaft, said wobble plate having an angle of axial inclination variable relative to said drive shaft for varying displacement of said compressor in response to a different between a resultant reaction force exerted by said pistons on compression strokes and pressure in said crankcase acting upon said pistons as back pressure, and a control valve arranged in a passage extending between said crankcase and said suction cavity for controlling the opening of said passage in response to pressure within said suction cavity so as to control the pressure within said crankcase and thus to enable the displacement of said compressor to be varied, wherein the improvement comprises:

a valve arrangement arranged in a duct provided in said cylinder block, said duct having one end which opens to said discharge cavity and another end opening to said crankcase, said valve arrangement being adapted to permit communication between said discharge cavity and said crankcase through said duct below a predetermined fluid pressure differential therebetween so that the angle of inclination of said wobble plate is adjusted to reduce the displacement of said compressor.

2. The invention according to claim 1 wherein the valve arrangement includes means for permitting continuous limited communication between said discharge cavity and said crankcase.

3. The invention according to claim 1 wherein said valve arrangement includes a spring biased needle valve adapted for movement in said duct between open and closed positions.

4. The invention according to claim 3 wherein said needle valve is biased toward a normally open position.

5. The invention according to claim 3 wherein said needle valve opens to permit fluid communication through said duct below a predetermined crankcase—discharge pressure differential.

6. In a variable displacement compressor having a crankcase wherein pressure is established and controlled, a cylinder block defining compression chambers into which fluid is admitted from a suction cavity and from which fluid is expelled under pressure into a discharge cavity, pistons received in respective ones of said compression chambers, a drive shaft, a wobble plate arranged in said crankcase and pivotally and slidably fitted on said drive shaft, said wobble plate having an angle of axial inclination variable relative to said drive shaft for varying displacement of said compressor in response to a difference between a resultant reaction force exerted by said pistons on compression strokes and pressure in said crankcase acting upon said pistons as back pressure, and a control valve arranged in a passage extending between said crankcase and said suction cavity for controlling the opening of said passage in response to pressure within said suction cavity so as to control the pressure within said crankcase and thus to enable the displacement of said compressor to be varied, wherein the improvement comprises:

passageway means provided in said cylinder block for providing communication between said discharge cavity and said crankcase; and compressor displacement control valve means disposed in said passageway means for regulating the mass flow therethrough below a predetermined crankcase—discharge pressure differential so that the angle of inclination of said wobble plate is adjusted to reduce the displacement of said compressor.

7. The invention according to claim 6 wherein said control valve means includes at least two spring biased valve assemblies both of which are adapted for displacement between open and closed positions.

8. The invention according to claim 6 wherein said valve assemblies are designed to open at different crankcase—discharge pressure differentials.

9. The invention according to claim 6 wherein said valve assemblies are designed to provide different mass flows to the crankcase at different crankcase—discharge pressure differentials.

10. In a variable displacement compressor of the variable angle wobble plate type having a crankcase wherein pressure is established and controlled, a cylinder block defining compression chambers into which fluid is admitted from a suction cavity and from which fluid is exhausted under discharge pressure into a discharge cavity, pistons received in respective ones of said compression chambers, a drive shaft, a wobble plate arranged in said crankcase and pivotally and slidably fitted on said drive shaft, said wobble plate having an angle of axial inclination variable relative to said drive shaft for varying displacement of said compressor in response to a difference between a resultant reaction force exerted by said pistons on compression strokes and pressure in said crankcase acting upon said pistons as back pressure, and a control valve arranged in a passage extending between said crankcase and said suction cavity for controlling the opening of said passage in response to pressure within said suction cavity so as to control the pressure within said crankcase and thus to enable the displacement of said compressor to be varied, wherein the improvement comprises:

at least two passages provided between the discharge cavity and the crankcase, and a displacement control valve assembly disposed in each of said passages, each of said control valve assembly being responsive to discharge—crankcase pressure differentials and operative in its associated passage to regulate a fluid flow from said discharge cavity to said crankcase in a manner so as to vary the wobble plate angle and thereby compressor displacement.

11. In a variable displacement compressor having a crankcase wherein pressure is established and controlled, a cylinder block defining compression chambers into which fluid is admitted from a suction cavity and from which fluid is expelled under pressure into a discharge cavity, pistons received in respective ones of said compression chambers, a drive shaft, a wobble plate arranged in said crankcase and pivotally and slidably fitted on said drive shaft, said wobble plate having an angle of axial inclination variable relative to said drive shaft for varying displacement of said compressor in response to a difference between a resultant reaction force exerted by said pistons on compression strokes and pressure in said crankcase acting upon said pistons as back pressure, wherein the improvement comprises:

passageway means provided in said cylinder block for providing communication between said discharge cavity and said crankcase; and compressor displacement control valve means disposed in said passageway means for regulating the mass flow therethrough below a predetermined crankcase—discharge pressure differential so that the angle of inclination of said wobble plate is adjusted to reduce the displacement of said compressor;

wherein said control valve means includes at least two spring biased valve assemblies both of which are adapted for displacement between open and closed positions.

12. The invention according to claim 11 wherein said valve assemblies are adapted to open at different crankcase—discharge pressure differentials.

13. The invention according to claim 11 wherein said valve assemblies are adapted to provide different mass flows to the crankcase at different crankcase—discharge pressure differentials.

14. In a variable displacement compressor of the variable angle wobble plate type having a crankcase wherein pressure is established and controlled, a cylinder block defining compression chambers into which fluid is admitted from a suction cavity and from which fluid is exhausted under discharge pressure into a discharge cavity, pistons received in respective ones of said compression chambers, a drive shaft, a wobble plate arranged in said crankcase and pivotally and slidably fitted on said drive shaft, said wobble plate having an angle of axial inclination variable relative to said drive shaft for varying displacement of said compressor in response to a difference between a resultant reaction force exerted by said pistons on compression strokes and pressure in said crankcase acting upon said pistons as back pressure, wherein the improvement comprises:

at least two passages provided between the discharge cavity and the crankcase, and a displacement control valve assembly disposed in each of said passages, each said control valve assembly being responsive to discharge—crankcase pressure differentials and operative in its associated passage to regulate a fluid flow from said discharge cavity to said crankcase in a manner so as to vary the wobble plate angle and thereby compressor displacement.

* * * * *